US005417838A

United States Patent [19]

Goleby

[11] Patent Number: 5,417,838

[45] Date of Patent: May 23, 1995

[54] FORMATION OF CONTOURED BUILDING PANELS BY DIRECT ELECTRODEPOSITION FROM LEACHATES OF COPPER ORES

[75] Inventor: Leslie D. Goleby, Coopers Plains, Australia

[73] Assignee: Tube Technology Pty. Ltd., Queensland, Australia

[21] Appl. No.: 844,649

[22] PCT Filed: May 17, 1991

[86] PCT No.: PCT/AU91/00212

§ 371 Date: Apr. 1, 1992

§ 102(e) Date: Apr. 1, 1992

[87] PCT Pub. No.: WO92/01087

PCT Pub. Date: Jan. 23, 1992

[30] Foreign Application Priority Data

Jul. 6, 1990 [AU] Australia ..... 58764/90

[51] Int. Cl.[6] ..... C25D 1/00

[52] U.S. Cl. ..... 205/67; 204/106

[58] Field of Search ..... 205/67, 2.5, 918; 204/157.4, 106

[56] References Cited

U.S. PATENT DOCUMENTS 4,395,313 7/1983 Lindsay et al. ..... 205/918

4,484,990 11/1984 Bultman et al. ..... 204/106

FOREIGN PATENT DOCUMENTS 2924314 12/1980 Germany .

21147/24 7/1925 United Kingdom .

244113 12/1926 United Kingdom .

600873 4/1948 United Kingdom .

OTHER PUBLICATIONS

The Encyclopeida of Electrochemistry, Clifford A. Hampel, Ed. Reinhold Publishing Corporation, New York (1964) pp. 246, 579-581.

Electrochemistry, Principles and Applications, Edmund C. Potter, Cleaver-Hume Press Ltd., London (1956), pp. 287, 307, 310.

*Primary Examiner*—John Niebling

*Assistant Examiner*—Brendan Mee

*Attorney, Agent, or Firm*—Merchant & Gould, Smith, Edell, Welter & Schmidt

[57] ABSTRACT

Copper roofing panels and like contoured articles are formed from copper sheets electrolytically deposited on an electrode during an electrowinning process. The contoured roofing panels are formed by pressing planar copper sheets stripped from an electrode or by pressing a laminate of copper sheet and a plastics substrate. In an alternative embodiment, roofing panels are formed by electrodeposition of copper onto a contoured electrode.

3 Claims, 3 Drawing Sheets

FORMATION OF CONTOURED BUILDING PANELS BY DIRECT ELECTRODEPOSITION FROM LEACHATES OF COPPER ORES

This invention is concerned with a metal forming process which is particularly, although not exclusively suitable for the formation of articles including profiled building elements such as copper roofing tiles, wall cladding and the like.

Of recent years, roofing tiles formed from pressed steel sheet have gained considerable popularity in the building industry due to ease of installation, relatively low unit cost, low mass and reduced structural costs. Notwithstanding the use of improved corrosion resistant finishes on such steel roofing tiles, they are quite susceptible to corrosion in regions of high air pollution or in seaside areas having high levels of airborne salt.

While it has been proposed to utilize sheet copper to produce pressed metal roofing tiles, the extremely high cost of copper sheet stock has mitigated against the use of this material.

Typically, sheet copper stock is produced initially from a solution of copper ore by an electrowinning process to produce a sheet of relatively pure copper about 3 mm thick on a stainless steel electrode measuring about 1200 mm square. The electrodeposited copper sheets are then stripped from the electrodes and then smelted down to form ingots. Such ingots are subsequently rolled in a rolling mill to produce sheet copper stock.

The major disadvantage associated with the production of sheet copper stock for manufacture of building components is the enormous value adding effect of multiple handling, transportation and processing costs as well as the costs associated with waste trimming in the final production of articles from copper sheet. Frequently, for example, copper ore is mined and a crude concentrate is produced therefrom by chemical means such as leaching, froth flotation, etc. The crude concentrate may then be transported a considerable distance to a source of cheap electricity such as a hydro-electric station. After electrodeposition, the stripped copper plates may then travel to another plant for smelting and casting and thereafter to yet another plant for smelting and casting and thereafter to yet another plant for rolling. It is estimated that marginal cost increases from the initial production of electrodeposited sheets and the purchase of sheet copper stock can increase the cost of copper as a feedstock in manufacturing processes by a factor of as much as five.

Accordingly, it is an aim of the present invention to overcome or ameliorate the disadvantages associated with the use of sheet copper stock in the manufacture of articles therefrom.

According to one aspect of the invention there is provided a method of producing contoured articles having at least one surface of metallic copper, said method comprising:

electrodepositing, from a copper containing solution comprising a copper concentrate obtained from beneficiation of copper ores, a layer of copper metal on an electrode of predetermined shape and configuration to produce an article having at least one exposed surface comprised substantially of copper metal.

Suitably the electrode may comprise a reusable electrode from which said article may be removed after electrodeposition.

Alternatively, the electrode may comprise a base for formation of an article of composite structure having at least one exposed surface comprised substantially of copper metal.

The electrode may be selected from any suitable electrically conductive material including metals, plastics, alloys of metals, alloys of plastics, composite materials or any combination thereof.

Alternatively the electrode may comprise a non-electrically conductive or semi-electrically conductive material having a coating of conductive material on at least one face thereof.

If required the electrode may include regions having non conductive surfaces.

The electrode may be adapted from manufacture of a single article, or a plurality of articles which may be the same or different. Preferably the copper containing solution comprises a leachate of copper ore. Alternatively, the copper containing solution may comprise a copper concentrate obtained from the treatment of copper ores.

Although the following description relates by way of non-limiting example to production of building materials, in particular, to roofing tiles, it should be understood that the method is applicable to the manufacture of a wide variety of articles for which a complete or partial coating of copper metal may be required.

In order that the invention may be more clearly understood, reference is now made to a number to illustrative examples and the attached drawings in which FIG. 1 illustrates an electrodeposited contoured metal roof tile;

EXAMPLE 1

A 1 mm thick sheet of stainless steel may be pressed in a conventional metal roofing tile press to form a contoured electrode of substantially the same configuration as a metal roof tile otherwise produced by that process.

Figure 1:
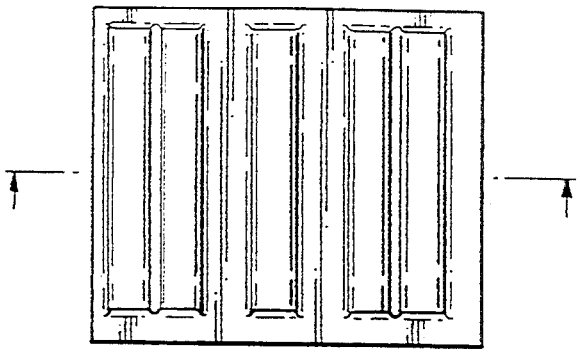
Figure 2:
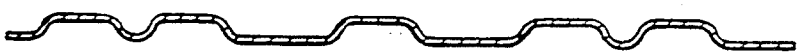
FIG. 2 illustrates a cross-section through A—A in FIG. 1.

FIG. 1 shows a plan view of an electrode contoured to a typical roof tile configuration and FIG. 2 shows a partial cross-sectional view through A—A in FIG. 1.

The "outer" face of the electrode (corresponding to an upper weathering face of a metal roof tile produced by a pressing process) is coated with a non-conducting surface finish such as a paint or other polymeric material.

The electrode is then lowered into the electrodeposition bath of a copper electrowinning plant and electrodeposition occurs under conditions substantially identical to those considered as "normal" for conventional electrowinning of copper metal. Under appropriate temperature, voltage and current conditions, a layer of copper 1.5 mm thick is built up on the surface of the electrode.

The electrode is then removed from the bath and the layer of deposited copper is stripped from the electrode to provide a contoured copper roofing tile at substantially the same cost as a sheet of electrowon cooper of similar dimensions thus avoiding the enormous costs otherwise associated with first producing rolled sheet copper and subsequently pressing and trimming roof tiles therefrom.

By electrodepositing the copper on the smooth rear face of the electrode, a roof tile having a smooth upper (or normally exposed) surface is formed. It will be found that under normal electrodeposition conditions, copper roofing tiles formed in this manner have a lustrous burnished finish with a range of attractive earthy coppery colours. This may be due to impurities in the copper solution derived directly from copper ore.

A slightly surface different effect can be produced by electrodeposition on the reverse side of a contoured metal electrode.

EXAMPLE 2

Figure 3:
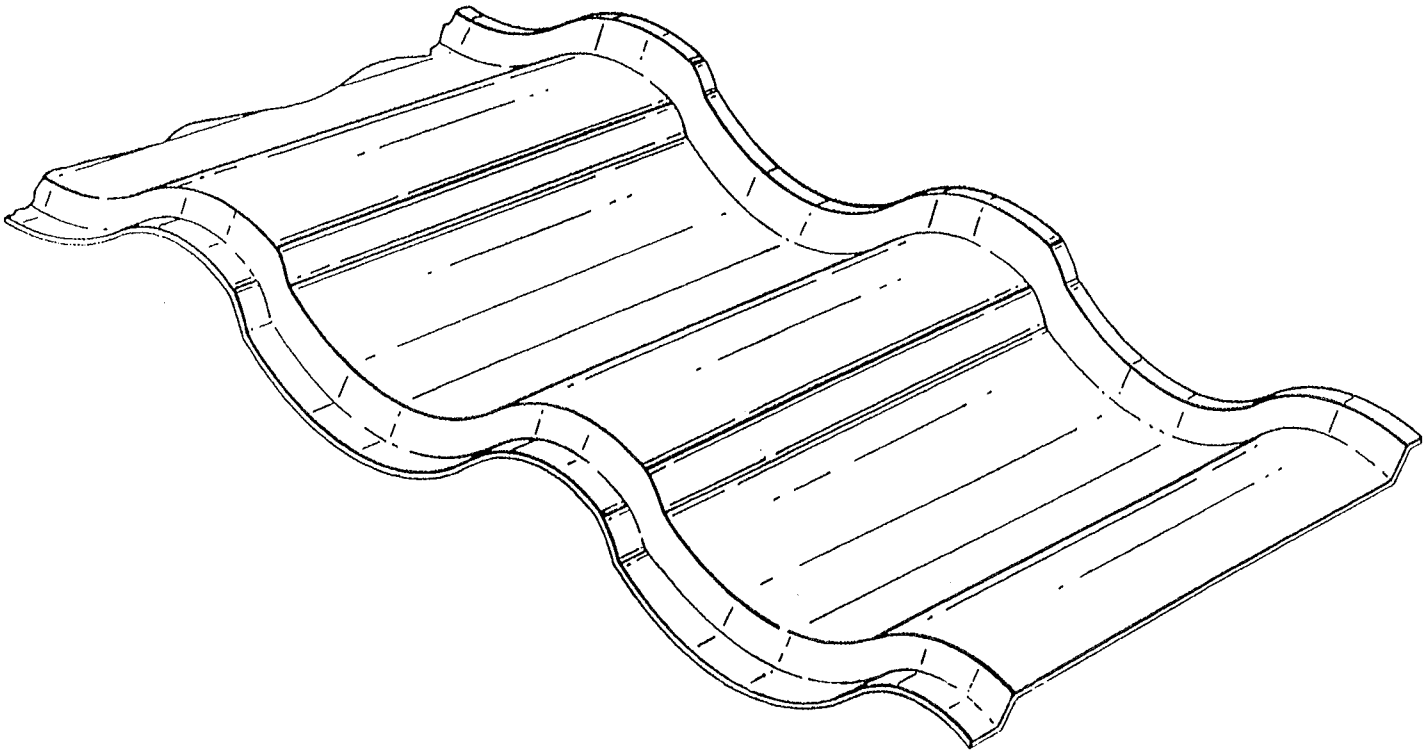
FIG. 3 illustrates an alternative roof tile panel configuration.

FIG. 3 shows a typical heavily contoured metal roofing tile.

Generally speaking, there are inherent limitations in the production of pressed metal roofing tiles due to constraints on metal thickness and ductility. Deeply contoured roofing tiles of the type shown in FIG. 3 pose no problem in an electrodeposition process and result in tiles of even thickness and strength while at the same time avoiding deformation creases and induced stresses normally associated with deep draw pressing. Furthermore, deep draw pressing of say steel sheet coated with decorative and/or anti-corrosion finishes frequently gives rise to perforation of such finishes.

EXAMPLE 3

Due to operational difficulties and capital cost constraints associated with pressing of large pressed metal roof tiles, it is uncommon to produce roofing panels greater than about 1350 mm in length.

Figure 4A:
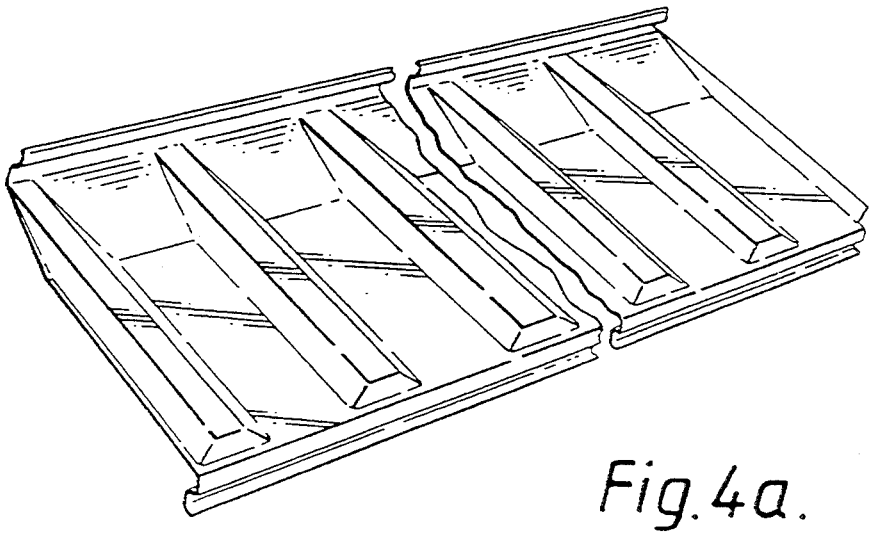
FIG. 4 illustrates yet another roof tile panel configuration.
Figure 4:
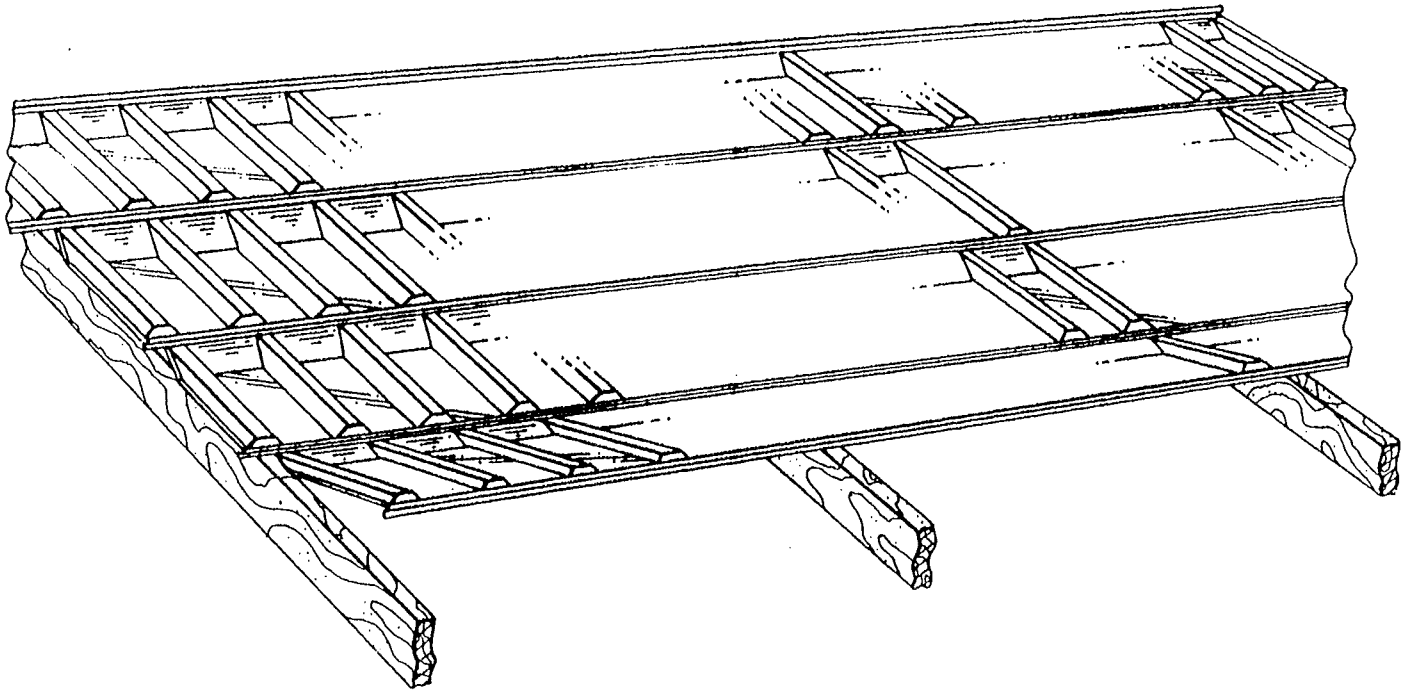

FIG. 4 shows the installation of elongate panels on a roof whereby substantial installation costs may be achieved.

Although elongate panels up to 5 m in length have been produced by the electrodeposition process, it is considered that the limitations of size of building panels or other articles produced by this process will depend only on limitations in electrodeposition tank dimensions and practical limitations in handling and transportation of such panels.

FIG. 4*a* shows another advantage of the present invention in that complex profiles including undercut regions may be readily incorporated. Although such complex shapes may be possible with conventional sheet metal presses, this necessitates the use of complex pressing dies with many moving parts.

EXAMPLE 4

Although it will be clear to a skilled addressee that building elements such as ridge capping, guttering large members etc complementary to roofing panels may also be produced by this process, these elements are largely non-structural in nature. Accordingly, rather than consume a relatively expensive elemental metal for merely decorative and/or weatherability purposes alone, preformed rolled or pressed steel, extruded or moulded plastics members may have deposited thereon a thin layer of copper.

The composite structure thus formed combines the advantages of durability and decorativeness of copper with the strength, light weight and lower cost of less durable materials to obtain the combined advantages of those materials without the particular disadvantages of those materials.

Useful composites may be formed according to the present invention.

Certain engineering or even common plastics for example may be produced or otherwise treated to provide a surface adapted for electrodeposition of copper. By careful selection of composite materials to provide advantageous properties complementary to the advantageous properties of copper metals, characteristics or properties otherwise disadvantageous in copper and such plastics materials may be alleviated to a practical extent or even cancelled completely.

A composite roofing tile structure may be formed for example by electrodeposition of a thin layer of copper on a preformed plastics structural base.

The preformed structural base may be formed by any suitable process such as injection moulding, compression moulding, vacuum forming or the like.

Any suitable plastics material such as thermoplastics resins or thermosetting resins may be employed and these resins may include functional fillers such as talc, glass fibre, carbon black, low density fillers etc to modify such properties as tensile and compressive strength, density, electrical conductivity, flammability etc.

By way of non-limiting example, such plastics materials may include ABS, Acetals, Acrylics, Epoxies, Polyesters, Melamines, Nylons, Phenolics, Polyamides, Butadienes, Polycarbonates, Polyethylenes, Polyimides, Polypropylenes, Polyurethanes, Polystyrenes, Silicones, Vinyls and the like including copolymers and alloys of those resins.

The preformed bases may be formed from solid plastics materials or cellular plastics.

EXAMPLE 5

A plastics structural "base" having the general configuration shown in FIG. 4*a* may be formed from a polycarbonate resin by injection moulding.

The upper or "weather" surface of the structural base is then subjected to an oxidizing process by a high voltage corona discharge to render the surface conductive.

The structural base member is then placed in an electrodeposition bath and a thin layer of copper metal, about 0.01 mm thick, is deposited on the surface of the polycarbonate base. The composite structure thus formed combines the superior physical properties of strength and low mass of the plastics base with the superior qualities of copper in chemical resistance and weatherability.

EXAMPLE 6

A panel of extruded ABS sheet measuring 3 mm in thickness may be treated by any convenient method to facilitate electrodeposition of copper on one face thereof.

After electrodeposition of a layer of copper about 0.15 mm thick, the copper coated panel is preheated to about 150 degrees C and then placed a vacuum forming mould to produce a roofing tile having a configuration as shown generally in FIG. 4*a*. The relatively thin copper surface layer is stretched in the regions of drawdown without substantially affecting an otherwise conventional vacuum forming process.

EXAMPLE 7

The copper coated panels of Example 6 may be placed in a heated compression mould having complementary male and female mould surfaces to produce a roofing tile panels as generally shown in FIG. 4*a*.

EXAMPLE 8

A planar sheet of copper measuring about 0.2 mm in thickness stripped from an electrodeposition electrode is placed in a compression mould having complementary male and female mould surfaces together with a quantity of polyester dough moulding compound (DMC).

The mould is closed under compression and after a suitable period, opened to produce a composite polyester/copper roofing tile or other product.

EXAMPLE 9

A planar sheet of copper measuring about 0.4 mm in thickness stripped from an electrodeposition electrode and is laminated to a 5 mm thick cellular sheet of flexible PVC using a suitable adhesive. The copper/foam PVC laminate is then pressed to produce an insulated roofing tile panel. The rigidity of the copper sheet is sufficient to retain the foam PVC sheet in the pressed shape.

EXAMPLE 10

A planar sheet of electrodeposited copper measuring 0.1 mm is initially pressed to the shape of a roofing tile panel and placed in a closable mould having a support surface complementary to the contours of the pressed copper sheet.

A quantity of expandable polyurethane is deposited in the mould which is then closed while the polyurethane foam expands. The product so produced is an insulated roofing tile panel.

EXAMPLE 11

A self-supporting, insulated copper clad roofing tile may be manufactured as a composite sandwich laminate.

A thin contoured sheet of electrodeposited copper may be placed in a mould and a quantity of expandable liquid polyurethane resin is also introduced into the mould. The mould closure member supports a pressed steel panel of similar or different contours to the contoured copper sheet.

The product of this process is a sandwich laminate comprising a rigid or flexible foam polyurethane core with a contoured copper skin on one side and a planar or contoured steel skin on the other side.

In addition to panel-like structures illustrated above, composite copper coated articles comprising the advantageous features of copper metal in conjunction with advantageous features of other materials may be made in accordance with the invention. The following example illustrates other copper composites which hitherto may have been manufactured from solid copper metal by a variety of processing techniques such as fabrication from rolled copper sheet, extrusion from cast copper billets, casting and the like.

EXAMPLE 12

An extruded plastics tubing or a roll formed metal tubing may be selectively treated to facilitate electrodeposition of copper on an inner surface, an outer surface or both.

The treated tubing is then subjected to electrodeposition of copper to a desired thickness to form a composite article having the aesthetic and chemical properties of copper on a required surface but otherwise possessing the more advantageous physical properties of the substrate material. Such properties may include physical strength, lower density, but above all lower cost.

The above examples clearly illustrate the applicability and economics associated with the use of electrodeposited copper sheets or electrodeposition of copper metal on suitable substrates to from solid copper articles or copper composites.

By interception of copper metal at a very early stage of its conventional processing cycle, significant economics in raw material costs and usage may be obtained that otherwise hitherto obtainable.

It will be readily apparent to a skilled addressee that many modifications or variations may be made in the products and the processes according to the invention without departing from the spirit and scope thereof.

I claim:

1. A method of producing a solid contoured building panel of metallic copper, said method comprising:

electrodepositing, from a copper containing solution comprising a copper concentrate obtained from beneficiation of copper ores, a layer of copper metal of desired thickness onto a surface of a cathode having a contoured configuration complimentary to the contoured building panel, and subsequently stripping said contoured copper building panel from said contoured cathode.

2. The method of claim 1, wherein the normally outer surface of said building panel is formed against the surface of said cathode.

3. The method of claim 1, wherein the normally inner surface of said building panel is formed against the surface of said cathode.

* * * * *